US009682457B2

(12) United States Patent
Feng et al.

(10) Patent No.: US 9,682,457 B2
(45) Date of Patent: Jun. 20, 2017

(54) COMPOSITE POLISHING PAD AND METHOD FOR MAKING THE SAME

(71) Applicant: San Fang Chemical Industry Co., Ltd., Kaohsiung (TW)

(72) Inventors: Chung-Chih Feng, Kaohsiung (TW); I-Peng Yao, Kaohsiung (TW); Wen-Chieh Wu, Kaohsiung (TW); Yung-Chang Hung, Kaohsiung (TW)

(73) Assignee: SAN FANG CHEMICAL INDUSTRY CO., LTD., Kaohsiung (TW)

( * ) Notice: Subject to any disclaimer, the term of this patent is extended or adjusted under 35 U.S.C. 154(b) by 253 days.

(21) Appl. No.: 14/500,227

(22) Filed: Sep. 29, 2014

(65) Prior Publication Data

US 2015/0093979 A1 Apr. 2, 2015

(30) Foreign Application Priority Data

Oct. 1, 2013 (TW) ..... 102135467 A

(51) Int. Cl.

| | |
|---|---|
| ***B24B 37/24*** | (2012.01) |
| ***B24B 37/22*** | (2012.01) |
| ***B24D 11/00*** | (2006.01) |

(52) U.S. Cl.

CPC ..... *B24B 37/22* (2013.01); *B24B 37/24* (2013.01); *B24D 11/003* (2013.01)

(58) Field of Classification Search

CPC . B24D 11/02; B24D 3/00; B24D 3/26; B24D 3/28; B24B 37/24

See application file for complete search history.

(56) References Cited

U.S. PATENT DOCUMENTS

2001/0041511 A1* 11/2001 Lack ..... B24B 37/24 451/41
2005/0197050 A1* 9/2005 Prasad ..... B24B 37/205 451/41

FOREIGN PATENT DOCUMENTS

| | | |
|---|---|---|
| TW | 567114 | 12/2003 |
| TW | I222390 | 10/2004 |
| TW | 201000262 A | 1/2010 |
| TW | I350565 | 10/2011 |
| WO | WO 03/039812 A1 | 5/2003 |
| WO | WO 2005/000527 A2 | 1/2005 |

OTHER PUBLICATIONS

Office action issued on Dec. 15, 2015 by Taiwan Intellectual Property Office for the counterpart Taiwan Patent Application No. 102135467.

(Continued)

*Primary Examiner* — Pegah Parvini

(74) *Attorney, Agent, or Firm* — WPAT, P.C., Intellectual Property Attorneys; Anthony King

(57) ABSTRACT

The present invention relates to a composite polishing pad and a method for making the same. The composite polishing pad includes a cushion layer and a polishing layer. The cushion layer includes a first polymeric elastomer with a hardness of 10 to 70 shore D, and is attached to the polishing layer directly. The polishing layer includes a second polymeric elastomer with a hardness of 30 to 90 shore D, and has a polishing surface for polishing a workpiece. Whereby, the polishing layer will not peel off from the cushion layer easily, so that the polishing quality is raised.

3 Claims, 5 Drawing Sheets

(56) References Cited

OTHER PUBLICATIONS

Search report issued on Dec. 15, 2015 by Taiwan Intellectual Property Office for the counterpart Taiwan Patent Application No. 102135467.
English translation of the search report issued on Dec. 15, 2015 by Taiwan Intellectual Property Office for the counterpart Taiwan Patent Application No. 102135467.
English abstract translation of TW 567114.
English abstract translation of TW I350565.
English abstract translation of TW 201000262A.
English abstract translation of TW I222390.

* cited by examiner

COMPOSITE POLISHING PAD AND METHOD FOR MAKING THE SAME

BACKGROUND OF THE INVENTION

1. Field of the Invention

The present invention relates to a composite polishing pad and a method for making the same, and more particularly to an adhesive-free composite polishing pad and a method for making the same.

2. Description of the Related Art

Referring to FIG. 1, a schematic view of a polishing device is shown. The polishing device 1 comprises a lower base plate 11, a sheet 12, a polishing workpiece 13, an upper base plate 14, a polishing pad 15 and slurry 16. The lower base plate 11 is opposite to the upper base plate 14. The sheet 12 is adhered to the lower base plate 11 through an adhesive layer 17 and is used for carrying and mounting the polishing workpiece 13. The polishing pad 15 is mounted on the upper base plate 14, faces the lower base plate 11, and is used for polishing the polishing workpiece 13.

The operation mode of the polishing device 1 is as follows. First, the polishing workpiece 13 is mounted on the sheet 12. Then, both the upper base plate 14 and the lower base plate 11 rotates and the upper base plate 14 is simultaneously moved downwards, such that the polishing pad 15 contacts the surface of the polishing workpiece 13. A polishing operation for the polishing workpiece 13 is performed by continuously supplementing the slurry 16 and using the polishing pad 15.

Referring to FIG. 2, an enlarged schematic sectional view of a conventional polishing pad is shown. The polishing pad 15 has a three-layer structure, and includes a cushion layer 151, an adhesion layer 152 and a polishing layer 153. The cushion layer 151 generally has high compression ratio and low hardness, and is fixed on the upper base plate 14. The polishing layer 153 generally has low compression ratio and high hardness, and contacts the surface of the polishing workpiece 13, so as to provide high removal rate and high uniformity. The adhesion layer 152 is a pressure-sensitive adhesive (PSA), and is used for bonding the cushion layer 151 and the polishing layer 153. However, the PSA has low adhesion strength and poor chemical resistance, so that the cushion layer 151 and the polishing layer 153 are easily separated or peeled off from each other, thereby further affecting the progress of polishing.

In another conventional technique, the adhesion layer 152 is a hot-melt adhesive. However, when the hot-melt adhesive is used to perform the composite manufacturing techniques of the polishing pad 15, stress accumulation easily occurs, resulting in deformation of the polishing pad 15.

Additionally, in the above two conventional techniques, the cushion layer 151 and the polishing layer 153 are laminated together by using the adhesion layer 152, so a lamination step is added to the process, thereby increasing the complexity of the process. In this case, the adhesion layer 152 is used additionally, and therefore, a layer of raw material (the adhesion layer 152) is used additionally in the process, thereby increasing the manufacturing costs.

Therefore, it is necessary to provide an innovative and inventive composite polishing pad and a method for making the same to solve the above problems.

SUMMARY OF THE INVENTION

The present invention provides a composite polishing pad. In an embodiment, the composite polishing pad comprises a cushion layer and a polishing layer. The cushion layer comprises a first polymeric elastomer with a hardness of 10 to 70 Shore D. The polishing layer is attached to the cushion layer directly, comprises a second polymeric elastomer with a hardness of 30 to 90 Shore D, and has a polishing surface for polishing a workpiece. Whereby, the cushion layer and the polishing layer are not easily separated or peeled off from each other, thereby improving the polishing quality. Additionally, no adhesion layer exists between the polishing layer and the cushion layer, thus solving the problem of deformation of the polishing pad due to stress accumulation in conventional composite manufacturing techniques. Furthermore, according to the present invention, the lamination step can be omitted in the process, thereby decreasing the complexity of the process and reducing the manufacturing costs.

The present invention further provides a method for making a composite polishing pad. In an embodiment, the method comprises the following steps of: (a) forming a first resin coating on a release paper; (b) pre-baking the first resin coating at a first temperature to a semi-ripening state; (c) forming a second resin coating on the semi-ripened first resin coating, so that the second resin coating directly contacts with the semi-ripened first resin coating; (d) drying the first resin coating and the second resin coating at a second temperature, so that the first resin coating becomes a cushion layer and the second resin coating becomes a polishing layer, wherein the second temperature is higher than the first temperature, the cushion layer has a hardness of 10 to 70 shore D, and the polishing layer has a hardness of 30 to 90 Shore D; and (e) removing the release paper to form a composite polishing pad, wherein the composite polishing pad comprises the cushion layer and the polishing layer.

The present invention further provides a method for making a composite polishing pad. In an embodiment, the method comprises the following steps of: (a) forming a second resin coating on a release paper; (b) pre-baking the second resin coating at a first temperature to a semi-ripening state; (c) forming a first resin coating on the semi-ripened second resin coating, so that the first resin coating directly contacts with the semi-ripened second resin coating; (d) drying the second resin coating and the first resin coating at a second temperature, so that the first resin coating becomes a cushion layer and the second resin coating becomes a polishing layer, wherein the second temperature is higher than the first temperature, the cushion layer has a hardness of 10 to 70 shore D, and the polishing layer has a hardness of 30 to 90 Shore D; and (e) removing the release paper to form a composite polishing pad, wherein the composite polishing pad comprises the cushion layer and the polishing layer.

BRIEF DESCRIPTION OF THE DRAWINGS

The invention will be described according to the appended drawings in which.

PREFERRED EMBODIMENT OF THE PRESENT INVENTION

Figure 3:
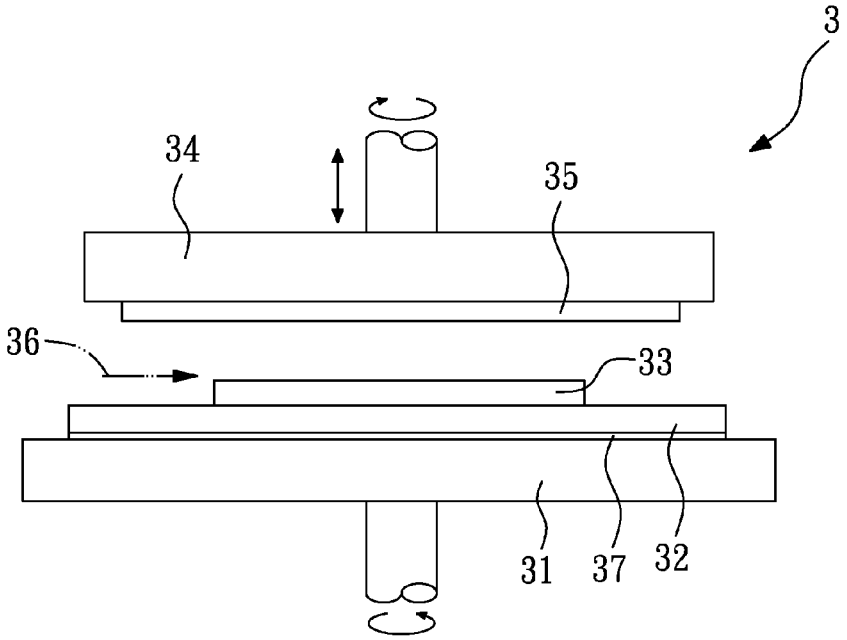
FIG. 3 is a schematic view of a polishing device of the present invention.

Referring to FIG. 3, a schematic view of a polishing device of the present invention is shown. The polishing device 3 comprises a lower base plate 31, a sheet 32, a polishing workpiece 33, an upper base plate 34, a composite polishing pad 35 and slurry 36. The lower base plate 31 is opposite to the upper base plate 34. The sheet 32 is adhered to the lower base plate 31 through an adhesive layer 37 and is used for carrying and mounting the polishing workpiece 33. The polishing workpiece 33 is selected from a group consisting of a semiconductor, a storage medium substrate, an integrated circuit, an LCD flat-panel glass, an optical glass and a photoelectric panel. The composite polishing pad 35 is mounted on the upper base plate 34, faces the lower base plate 31, and is used for polishing the polishing workpiece 33.

The operation mode of the polishing device 3 is as follows. First, the polishing workpiece 33 is mounted on the sheet 32. Then, both the upper base plate 34 and the lower base plate 31 rotates and the upper base plate 34 is simultaneously moved downwards, such that the composite polishing pad 35 contacts the surface of the polishing workpiece 33. A polishing operation for the polishing workpiece 33 is performed by continuously supplementing the slurry 36 and using the composite polishing pad 35.

Figure 1:
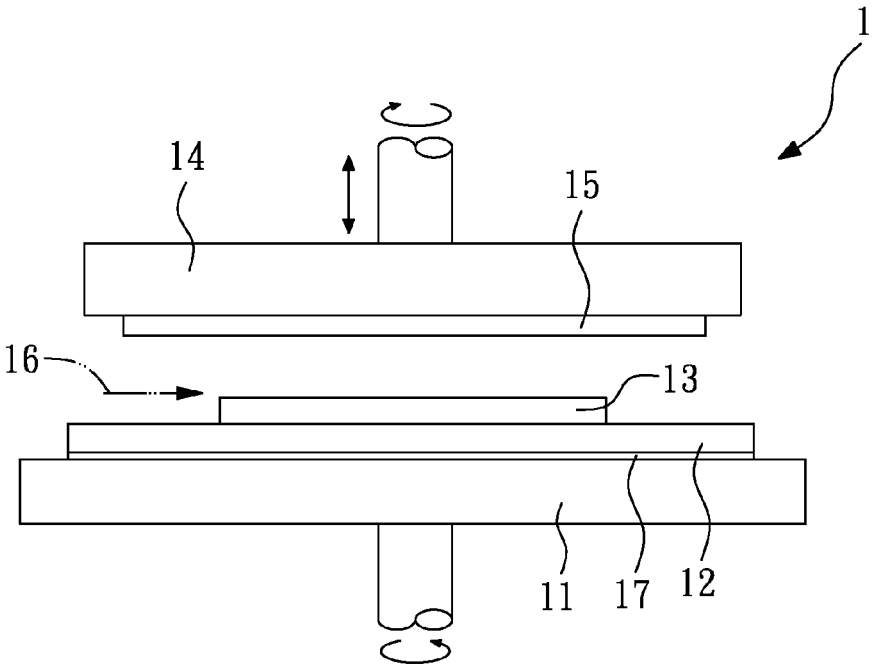
FIG. 1(Prior Art)
FIG. 1 is a schematic view of a conventional polishing device.
Figure 2:
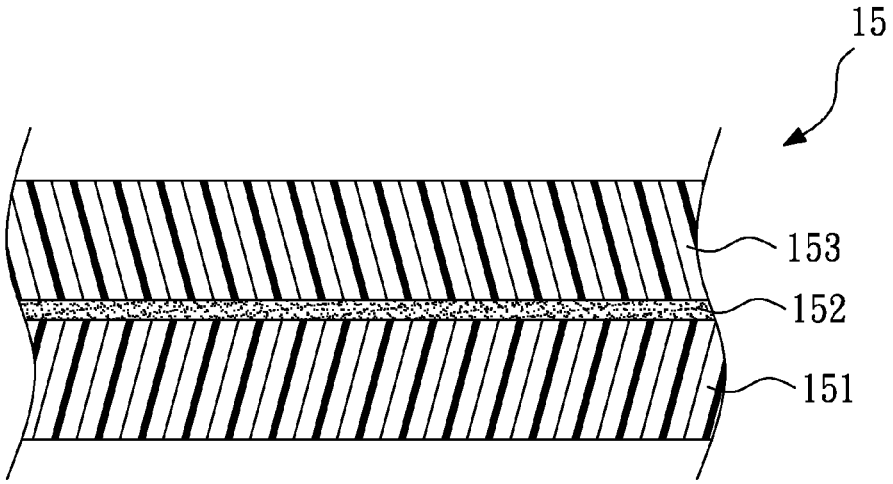
FIG. 2(Prior Art)
FIG. 2 is an enlarged schematic sectional view of a conventional polishing pad.
Figure 4:
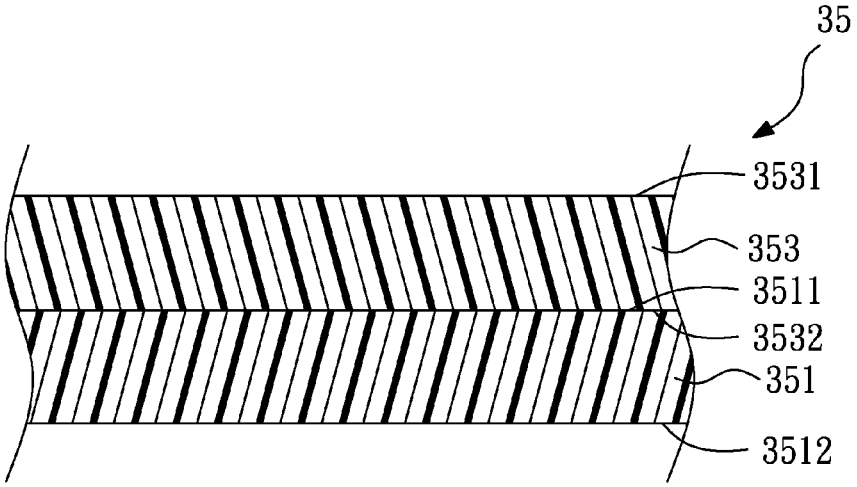
FIG. 4 is an enlarged schematic sectional view of a composite polishing pad of the present invention.

Referring to FIG. 4, an enlarged schematic sectional view of a composite polishing pad of the present invention is shown. The composite polishing pad 35 has a double-layer structure, and includes a cushion layer 351 and a polishing layer 353. The difference between the composite polishing pad 35 and the conventional polishing pad 15 (FIG. 2) lies in that the cushion layer 351 is in directly contact with and combined to the polishing layer 353 without any adhesion layer therebetween. The cushion layer 351 includes a first polymeric elastomer with a hardness of 10 to 70 Shore D to serve as a cushion. In this embodiment, the first polymeric elastomer includes a first ingredient and a second ingredient, the first ingredient has a hydroxyl group, an amino group, a mixture thereof or an oligomer thereof, and the second ingredient has a diisocyanate group. The hydroxyl group may be, for example, 1,4-butanediol (1,4BG) or 1,6-hexanediol (1,6HG). The amino group may be, for example, isophorone diamine (IPDA) or 4,4-methylenebis(2-chloroaniline). The second ingredient may be, for example, tolyene diisocyanate (TDI) or methylene bisphenyl isocynate (MDI). In this embodiment, the cushion layer 351 has a thickness of about 1.0 mm, and has a first surface 3511 and a second surface 3512, where the second surface 3512 is fixed on the upper base plate 34.

The polishing layer 353 directly contacts with the cushion layer 351, includes a second polymeric elastomer, and has a hardness of 30 to 90 Shore D. In this embodiment, the second polymeric elastomer includes a first ingredient and a second ingredient, the first ingredient has a hydroxyl group, an amino group, a mixture thereof or an oligomer thereof, and the second ingredient has a diisocyanate group. It should be noted that, the material of the second polymeric elastomer is different from that of the first polymeric elastomer. In this embodiment, the polishing layer 353 has a thickness of 0.5 mm to 0.7 mm, and has a first surface 3531 and a second surface 3532, where the first surface 3531 is used for contacting with the surface of a polishing workpiece 33, so as to provide high removal rate and high uniformity. In other words, the first surface 3531 is a polishing surface, and is used for polishing the polishing workpiece 33. The second surface 3532 of the polishing layer 353 is in directly direct contact with and combined to the first surface 3511 of the cushion layer 351, preferably, the second surface 3532 of the polishing layer 353 and the first surface 3511 of the cushion layer 351 are combined through chemical bonding. In this embodiment, the compression ratio of the cushion layer 351 is preferably 10% to 30%, and the size of voids in the cushion layer 351 is greater than 300 μm; and the compression ratio of the polishing layer 353 is preferably 1% to 5%, and the size of voids in the polishing layer 353 is less than 200 μm.

In the present invention, the peel strength between the polishing layer 353 and the cushion layer 351 is greater than 3 kg/cm, and preferably, greater than 5 kg/cm, so as to solve the problem in the prior art that the progress of polishing is affected because the cushion layer and the polishing layer are easily separated or peeled off from each other, thereby improving the polishing quality. Additionally, no adhesion layer exists between the polishing layer 353 and the cushion layer 351, thus solving the problem of deformation of the polishing pad due to stress accumulation in conventional composite manufacturing techniques. Furthermore, according to the present invention, the lamination step can be omitted in the process, thereby decreasing the complexity of the process and reducing the manufacturing costs.

Figure 5:
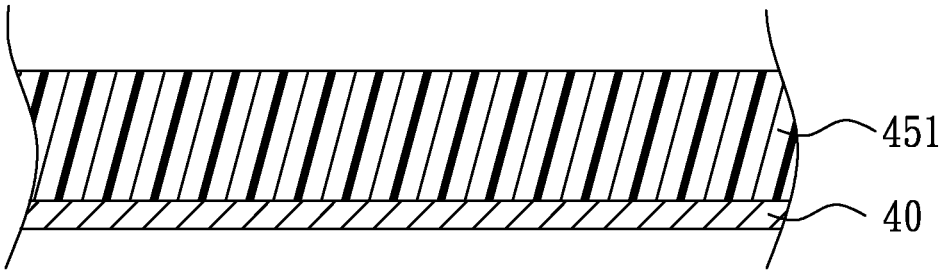
FIG. 5 to FIG. 7 are schematic views of an embodiment of a method for making a composite polishing pad of the present invention.
Figure 6:
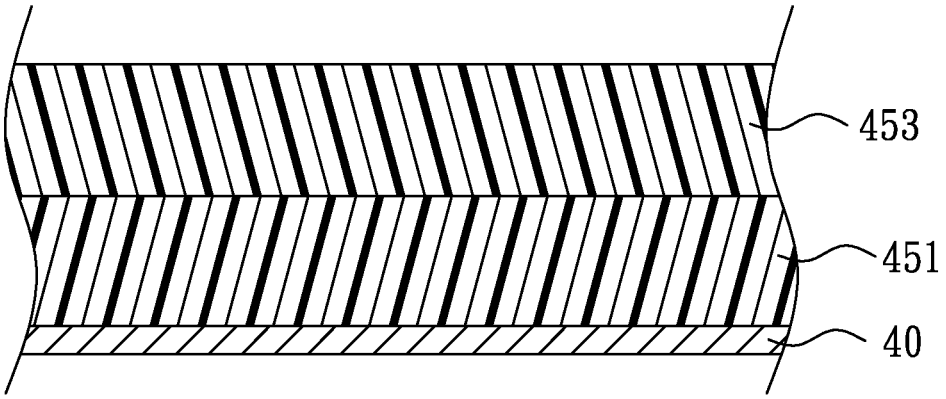
Figure 7:
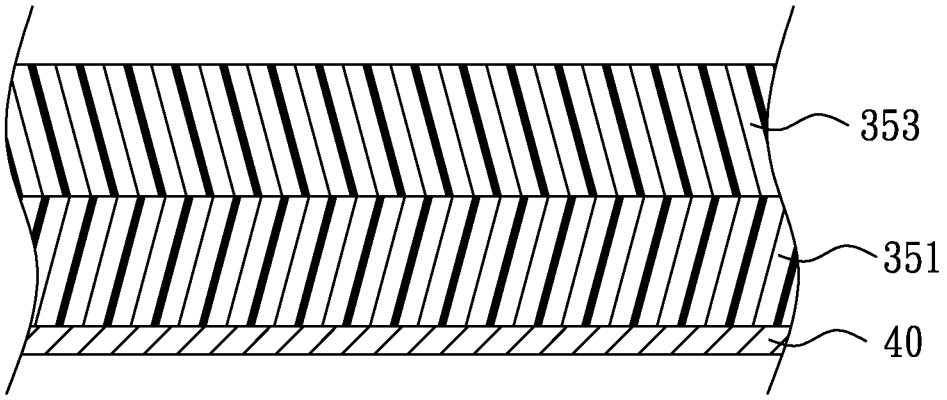

Referring to FIG. 5 to FIG. 7, schematic views of an embodiment of a method for making a composite polishing pad of the present invention are shown. Referring to FIG. 5, a release paper 40 is provided. Next, a first resin coating 451 is formed (for example, coated) on the release paper 40. In this embodiment, the first resin coating 451 includes a first polymeric elastomer and a first solvent, is in the liquid state, and has a temperature of about 30° C. to 40° C. The first polymeric elastomer includes a first ingredient and a second ingredient, the first ingredient has a hydroxyl group, an amino group, a mixture thereof or an oligomer thereof, and the second ingredient has a diisocyanate group. The hydroxyl group may be, for example, 1,4-butanediol (1,4BG) or 1,6-Hexanediol (1,6HG). The amino group may be, for example, isophorone diamine (IPDA) or 4,4-methylenebis (2-chloroaniline). The second ingredient may be, for example, tolyene diisocyanate (TDI) or methylene bisphenyl isocynate (MDI). The first resin coating 451 has a viscosity of 3,500 to 4,600 cps; and the first solvent may be an amide, a benzene, an ketone or a mixture thereof.

Then, the first resin coating 451 is pre-baked at a first temperature to a semi-ripening state. In this embodiment, the first temperature is 40° C. to 130° C., and preferably about 80° C. (depending on the material of the first solvent). Moreover, the pre-baking time is about 30 to 50 min, and preferably 40 min. In this way, a part or all of the first solvent is volatilized, and the first resin coating 451 becomes a jellylike state. Meanwhile, the first resin coating 451 is in a semi-ripening state rather than a ripening state.

Referring to FIG. 6, a second resin coating 453 is formed (for example, coated) on the semi-ripened first resin coating 451, so that the second resin coating 453 directly contacts with the semi-ripened first resin coating 451. In this embodiment, the second resin coating 453 includes a second polymeric elastomer and a second solvent, is in a liquid state, and has a temperature of about 30° C. to 40° C. The second polymeric elastomer includes a first ingredient and a second ingredient, the first ingredient has a hydroxyl group, an amino group, a mixture thereof or an oligomer thereof, and the second ingredient has a diisocyanate group. It should be noted that, the second resin coating 453 is different form the first resin coating 451. The second resin coating 453 has a viscosity of 8,100 to 8,800 cps; and the second solvent may be an amide, a benzene, an ketone or a mixture thereof.

Referring to FIG. 7, the first resin coating 451 and the second resin coating 453 are dried at a second temperature, so as to cure the first resin coating 451 to become a cushion layer 351 and cure the second resin coating 453 to become a polishing layer 353, where the second temperature is higher than the first temperature, the cushion layer 351 has a hardness of 10 to 70 shore D, and the polishing layer 353 has a hardness of 30 to 90 Shore D. At this time, the cushion layer 351 and the polishing layer 353 are combined through chemical bonding, and the peel strength therebetween is greater than 3 kg/cm, and preferably, greater than 5 kg/cm. In this embodiment, the second temperature is 100° C. to 140° C., and preferably about 120° C. (depending on the materials of the first solvent and second solvent). Moreover, the drying time is about 10 to 30 min, and preferably 20 min. Meanwhile, the cushion layer 351 and the polishing layer 353 are in a pre-ripening state.

Preferably, a ripening step is further performed. In other words, the cushion layer 351, the polishing layer 353 and the release paper 40 are placed in a ripening box for 1 to 2 days, where the ripening box has a temperature of 60° C. to 80° C. Then, the cushion layer 351, the polishing layer 353 and the release paper 40 are taken out from the ripening box and placed at room temperature for about 1 day.

Finally, the release paper 40 is removed, and a release step is performed, so as to form a composite polishing pad 35, as shown in FIG. 4, where the composite polishing pad 35 includes the cushion layer 351 and the polishing layer 353. Preferably, surface finishing may be further performed on the first surface 3531 (that is, the polishing surface) of the polishing layer 353, so as to improve the polishing effect of the composite polishing pad 35.

Additionally, in another embodiment, the release paper 40 is a continuous release paper 40 and is continuously provided for continuous production. The release paper 40 has a flat, matte or mirror surface or a surface with texture. Therefore, the first resin coating 451 and the second resin coating 453 are also continuously formed (for example, coated). Next, after the drying step or the release step, a cutting step is performed to form a plurality of composite polishing pads 35.

Figure 8:
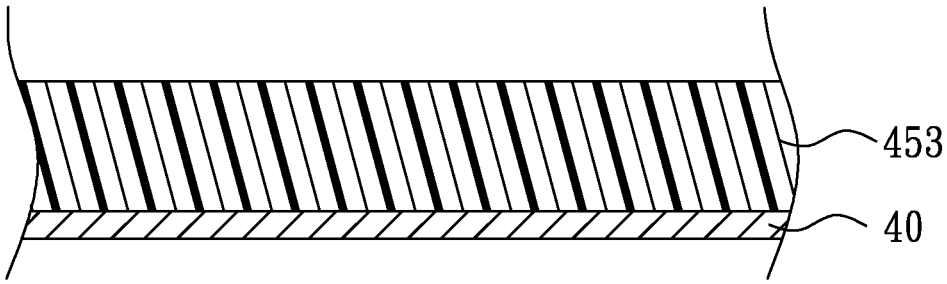
FIG. 8 to FIG. 10 are schematic views of another embodiment of a method for making a composite polishing pad of the present invention.
Figure 9:
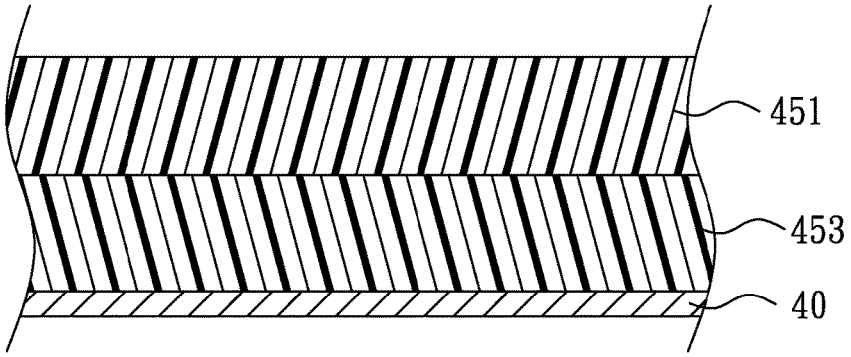
Figure 10:
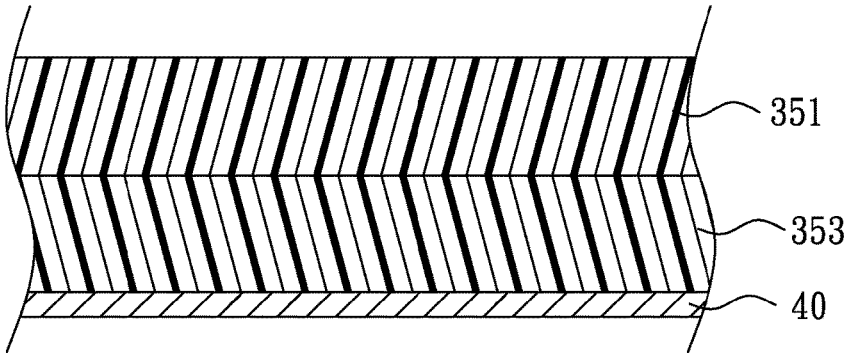

Referring to FIG. 8 to FIG. 10, schematic views of another embodiment of a method for making a composite polishing pad of the present invention are shown. Referring to FIG. 8, a release paper 40 is provided. Next, the second resin coating 453 is formed (for example, coated) on the release paper 40. The second resin coating 453 of this embodiment is the same as the second resin coating 453 of the embodiment in FIG. 5 to FIG. 7.

Then, the second resin coating 453 is pre-baked at a first temperature to a semi-ripening state. In this embodiment, the first temperature is 40° C. to 130° C., and preferably about 80° C. (depending on the material of second solvent). Moreover, the pre-baking time is about 30 to 50 min, and preferably 40 min. In this way, a part or all of the second solvent is volatilized, and the second resin coating 453 becomes a jellylike state. Meanwhile, the second resin coating 453 is in a semi-ripening state rather than a ripening state.

Referring to FIG. 9, a first resin coating 451 is formed (for example, coated) on the semi-ripened second resin coating 453, so that the first resin coating 451 directly contacts with the second resin coating 453. The first resin coating 451 of this embodiment is the same as the first resin coating 451 of the embodiment in FIG. 5 to FIG. 7.

Referring to FIG. 10, the second resin coating 453 and the first resin coating 451 are dried at a second temperature, so as to cure the first resin coating 451 to become the cushion layer 351 and to cure the second resin coating 453 to become the polishing layer 353, where the second temperature is higher than the first temperature, the cushion layer 351 has a hardness of 10 to 70 shore D, and the polishing layer 353 has a hardness of 30 to 90 Shore D. In this case, the cushion layer 351 and the polishing layer 353 are combined through chemical bonding, and the peel strength therebetween is greater than 3 kg/cm, and preferably, greater than 5 kg/cm. In this embodiment, the second temperature is 100° C. to 140° C., and preferably about 120° C. (depending on the materials of the first solvent and second solvent). Moreover, the drying time is about 10 to 30 min, and preferably 20 min. At this time, the cushion layer 351 and the polishing layer 353 are in a pre-ripening state.

Preferably, a ripening step is further performed. In other words, the cushion layer 351, the polishing layer 353 and the release paper 40 are placed in a ripening box for 1 to 2 days, where the ripening box has a temperature of 60° C. to 80° C. Then, the cushion layer 351, the polishing layer 353 and the release paper 40 are taken out from the ripening box and placed at room temperature for about 1 day.

Finally, the release paper 40 is removed, and a release step is performed, so as to form a composite polishing pad 35, as shown in FIG. 4, where the composite polishing pad 35 includes the cushion layer 351 and the polishing layer 353. Preferably, surface finishing may be further performed on the first surface 3531 (that is, the polishing surface) of the polishing layer 353, so as to improve the polishing effect of the composite polishing pad 35.

Additionally, in another embodiment, the release paper 40 is a continuous release paper 40 and is continuously provided for continuous production. The release paper 40 has a flat, matte or mirror surface or a surface with texture. Therefore, the first resin coating 451 and the second resin coating 453 are also continuously formed (for example, coated). Next, after the drying step or the release step, a cutting step is performed to form a plurality of composite polishing pads 35.

Additionally, the surface of the release paper 40 may also has texture, and the texture is used to form fine grooves on the polishing layer 353, which is conducive to the polishing effect of polishing.

The principle and the efficacies of the present invention have been disclosed above, and are not used to limit the present invention. Therefore, modifications and variations of the embodiments made by persons skilled in the art do not depart from the spirit of the invention Therefore, the protection scope of the present invention is defined by the scope of the following claims.

What is claimed is:

1. A method for making a composite polishing pad, comprising the following steps:

(a) forming a first resin coating on a release paper;

(b) pre-baking the first resin coating at a first temperature of 40° C. to 130° C. to a semi-ripening state;

(c) forming a second resin coating on the semi-ripened first resin coating, so that the second resin coating directly contacts with the semi-ripened first resin coating;

(d) drying the first resin coating and the second resin coating at a second temperature of 100° C. to 140° C., so that the first resin coating becomes a cushion layer and the second resin coating becomes a polishing layer, wherein the second temperature is higher than the first temperature, the cushion layer has a hardness of 10 to 70 shore D, and the polishing layer has a hardness of 30 to 90 Shore D; and (e) removing the release paper to form a composite polishing pad, wherein the composite polishing pad comprises the cushion layer and the polishing layer.

2. The method of claim 1, wherein in the step (a), the first resin coating comprises a first polymeric elastomer and a first solvent, the first polymeric elastomer comprises a first ingredient and a second ingredient, the first ingredient has a hydroxyl group, an amino group, a mixture thereof or an oligomer thereof, and the second ingredient has a diisocyanate group; in the step (b), a part or all of the first solvent is volatilized, so that the first resin coating becomes a jellylike state; in the step (c), the second resin coating comprises a second polymeric elastomer and a second solvent, the second polymeric elastomer comprises a first ingredient and a second ingredient, the first ingredient has a hydroxyl group, an amino group, a mixture thereof or an oligomer thereof, and the second ingredient has a diisocyanate group; and in the step (d), the cushion layer and the polishing layer are combined through chemical bonding.

3. The method of claim 1, wherein in the step (a), the release paper is a continuous release paper and is continuously provided; after the step (d) or the step (e), a cutting step is further performed to form a plurality of composite polishing pads.

* * * * *